US008960311B2

(12) United States Patent
Ong et al.

(10) Patent No.: US 8,960,311 B2
(45) Date of Patent: Feb. 24, 2015

(54) HIGH PRESSURE SEAL ADAPTER FOR SPLITTER CONDUCTOR HOUSING TO WELLHEAD CONNECTION

(75) Inventors: Wee Ming Ong, Singapore (SG); Yeong Soon Tang, Singapore (SG)

(73) Assignee: KOP Surface Products Singapore Pte. Ltd., Singapore (SG)

( * ) Notice: Subject to any disclaimer, the term of this patent is extended or adjusted under 35 U.S.C. 154(b) by 301 days.

(21) Appl. No.: 13/521,648

(22) PCT Filed: Jan. 12, 2010

(86) PCT No.: PCT/SG2010/000002

§ 371 (c)(1),
(2), (4) Date: Sep. 28, 2012

(87) PCT Pub. No.: WO2011/087450

PCT Pub. Date: Jul. 21, 2011

(65) Prior Publication Data

US 2013/0025879 A1 Jan. 31, 2013

(51) Int. Cl.
*E21B 23/00* (2006.01)
*E21B 33/047* (2006.01)

(52) U.S. Cl.
CPC ..... *E21B 33/047* (2013.01)
USPC ..... 166/378; 166/75.11; 166/85.3; 175/57

(58) Field of Classification Search
CPC ..... E21B 33/047; E21B 33/02; E21B 7/00
USPC ..... 166/377, 378, 75.11, 85.3; 175/57
See application file for complete search history.

(56) References Cited

U.S. PATENT DOCUMENTS

| | | | | |
|---|---|---|---|---|
| 5,103,900 | A | 4/1992 | McCleod et al. | |
| 5,240,081 | A | 8/1993 | Milberger et al. | |
| 5,330,007 | A | 7/1994 | Collins et al. | |
| 5,560,435 | A | 10/1996 | Sharp | |
| 5,655,602 | A * | 8/1997 | Collins | 166/313 |
| 5,810,086 | A * | 9/1998 | Bridges | 166/349 |
| 6,056,059 | A | 5/2000 | Ohmer | |
| 6,142,235 | A * | 11/2000 | Monjure et al. | 166/349 |
| 6,311,776 | B1 | 11/2001 | Pringle et al. | |
| 6,736,212 | B2 * | 5/2004 | Liew | 166/313 |
| 2008/0271924 | A1 * | 11/2008 | Lurie et al. | 175/57 |

OTHER PUBLICATIONS

International Search Report, Form PCT/ISA/210, Application No. PCT/SG2010/000002, filed Jan. 12, 2010, 3 pp.
Office Action issued in corresponding Chinese Patent Application No. 201080064834.9 on Jul. 14, 2014, consisting of 6 pp.

* cited by examiner

*Primary Examiner* — Yong-suk (Philip) Ro
(74) *Attorney, Agent, or Firm* — Volpe and Koenig, P.C.

(57) ABSTRACT

A high pressure seal adapter for a conductor housing of a wellhead, and a method of completing a well having a conductor housing attached thereto, are disclosed. The high pressure seal adapter has a unitary body including a first circular bore extending through the unitary body. The first circular bore has a circular perimeter extending beyond a centerline of the unitary body. The unitary body further includes a second circular bore adjacent the first circular bore and extending through the unitary body. The seal adapter is configured to be installed in the conductor housing. The method includes providing such a high pressure seal adapter and installing the high pressure seal adapter in the conductor housing.

15 Claims, 12 Drawing Sheets

HIGH PRESSURE SEAL ADAPTER FOR SPLITTER CONDUCTOR HOUSING TO WELLHEAD CONNECTION

FIELD OF INVENTION

Embodiments of the present invention provide a high pressure seal adapter that connects a splitter conductor housing to a wellhead of a well.

BACKGROUND

In the drilling industry, the term well completion is often used to denote the operations that prepare a well bore for producing oil or gas from the reservoir. It may similarly refer to a completed wellhead assembly. The goal of these operations is to install a wellhead and other connections to optimize the flow of the reservoir fluids into the well bore, up through the producing string, and into the surface collection system.

To begin a drilling operation a conductor pipe may be driven into the ground to prevent the loose surface soil from caving into the hole as the upper portion of the borehole is being drilled. Various components are then attached to the conductor pipe. A single conductor for 2 or more well completions is often used as it provides benefits such as smaller platform sizes and reduced installation time. Each well completion requires one wellhead to be installed before oil/gas production can commence. Thus 2 or more separate wellheads may be provided in a single conductor.

FIG. 1 shows a cross-sectional view of one example of a prior art conductor pipe assembly, designated generally as reference numeral 10. FIG. 1A illustrates a close-up cross-sectional view of the circled portion "A" of FIG. 1. FIG. 2 illustrates a cross-sectional view of the assembly 10 of FIG. 1 with two wellheads attached. FIG. 3 illustrates a top perspective view of the conductor housing of FIGS. 1 and 2.

With continuing reference to FIGS. 1-3, the assembly 10 includes a conductor 12 and a conductor housing 20 mounted to a top 14 of the conductor 12. The conductor housing 20 includes two cylindrical holes 24*a*, 24*b* separated by a central section 26 that extends longitudinally into the central bore of the conductor 12. The two cylindrical holes 24*a*, 24*b* of the assembly 10 facilitate the drilling of 2 separate wells 6, 8 (represented graphically as the centerlines of the holes 24*a*, 24*b*) within the conductor 12. Typically, the following steps are required to complete the connection between the conductor housing 20 and each wellhead 30*a*, 30*b* (FIG. 2). Usually, only one well (6 or 8) is worked on and the other well 6, 8 is covered with a debris cap 16.

For example as shown in FIG. 1, during the installation phase, a riser 40 that is used to protect the well fluids from the environment is required to be installed before any drilling operations. In this example, the riser 40 is installed above well 6. One or more seals 42 are located at the bottom of the riser 40 between an outside surface 44 of the riser 40 and an inside surface 22 of the conductor housing 20. In this prior art assembly, the seals 42 directly contact the conductor housing 20.

A separate debris cap 16 is installed on the conductor housing 20 to protect well 8. As best shown in FIG. 1A, the debris cap 16 includes one or more seals 17 between the debris cap 16 and the inside surface 22 of the central portion 26 of hole 24*a* in the conductor housing 20. In this prior art wellhead, the riser 40 seals directly onto the conductor housing 20. The "Sealing Thickness", shown as $T_s$, must be sufficient to hold pressure regardless of whether the riser 40 is installed in either of the cylindrical holes 24*a*, 24*b* above the well bores 6, 8. The thickness of the riser 40 is shown as $T_r$. The total available thickness for well drilling operations is shown as $T_{total}$. The portion marked $T_w$ is "Wasted Thickness" which is there to provide for the riser 40 to be installed when drilling operations are switched to the other bore. When no drilling operations go through that bore, the area is dead space and is considered wasted. This wasted thickness $T_w$ is undesirable.

After the well 6 is drilled through, a casing hanger 50 (FIG. 2) is installed, and a casing 55 is inserted into the well 6. The riser 40 is then dismantled. Subsequently, the wellhead 30*a* is installed onto the conductor housing 20. One or more seals 32 may be installed on an inside surface 34 of the wellhead 30*a* to provide a leak-proof connection to an outside surface 52 of the casing hanger 50.

In such a conductor splitter application, the wells 6, 8 have to be located close to each other, constrained by the internal diameter of the conductor 12, and the thickness $T_{total}$ of the central section 26 of the conductor housing 20. Furthermore, the center to center distance 18 between well 6 and well 8 is constrained to allow two separate vertical bores to pass through the conductor housing 20 through cylindrical holes 24*b*, 24*a*, respectively. As the riser 40 and subsequently the wellhead 30*a*, 30*b* must be fitted within the boundary of each bore for well isolation, the wall thickness of the riser 40 is also constrained. The internal diameter of the riser 40 is also constrained by the minimum allowed diameter based on industry standards. Similarly, as the bottom of the riser 40 seals directly on the conductor housing 20, the central section 26 must be sufficiently thick to withstand the well pressure and allow sealing on either side of the bore. These constraints limit the amount of pressure under which the wells 6, 8 may operate. For example, in typical well completions as shown in FIGS. 1 and 2, each well may be constrained to operate at a pressure of 3000 psi (20.6 MPascal) or less.

One solution to increase the available pressure in the wellhead is to use a smaller drill bit that would allow for a thicker riser wall. However, using a smaller drill bit also results in a smaller casing size for the well. While the operating pressure of the resulting well may be increased, the overall volume is less than what would be produced using the larger drill bit at the higher pressure. This is often unacceptable to the operator of the well. An alternate solution is to provide a larger conductor, thus increasing the center to center distance between the wells, so that the original drill bit may be used, and appropriate high-pressure wellheads installed. This option may greatly increase the cost of the required wellhead equipment.

Yet another solution is to use an underreamer which is able to pass through the riser and subsequently expand the cutter arms to enlarge the borehole. However, this solution increases both the time required and the costs associated with the drilling operation.

SUMMARY

One aspect of the present invention provides a high pressure seal adapter for a conductor housing of a wellhead, the high pressure seal adapter having a unitary body comprising: a first circular bore extending through said unitary body; and a second circular bore adjacent said first circular bore and extending through said unitary body; wherein said seal adapter is capable of being installed in said conductor housing.

In alternate embodiments, the high pressure seal adapter may further include at least one seal extending around a perimeter of said unitary body, said at least one seal contacting said conductor housing. The adapter may receive a high pressure riser in said first circular bore when said seal adapter is installed in said conductor housing, said high pressure riser having a lower surface that contacts said flange and at least one seal extending around an outside perimeter of said riser, said at least one seal contacting said side wall to facilitate well drilling operations through said high pressure riser and said first bore for a first well.

In further embodiments, the high pressure seal adapter may further include an upper and lower planar surface, wherein said lower planar surface rests on a flange of said conductor housing and said upper planar surface is substantially co-planar with an upper surface of said conductor housing when said seal adapter is installed in said conductor housing. The seal adapter may be rotated 180 degrees and installed in said conductor housing to facilitate well drilling operations for a second well. The high pressure seal adapter may be capable of operating at well pressures up to 34.5 Mega Pascals.

An alternate aspect of the present invention provides a method of facilitating high pressure drilling and extraction operations for a well, the well comprising a conductor having a conductor housing attached thereto, the method comprising the steps of: providing high pressure seal adapter having a unitary body comprising: a first circular bore extending through said unitary body; and a second circular bore adjacent said first circular bore and extending through said unitary body; and installing said seal adapter in said conductor housing.

In alternate embodiments, the method may further include connecting a high pressure riser to said conductor housing, said high pressure riser having a lower surface that extends into said first circular bore and contacts said flange, and at least one seal extending around an outside perimeter of said riser, said at least one seal contacting said side wall to facilitate well drilling operations through said high pressure riser and said first bore for a first well.

In other embodiments, when said well drilling operations are completed for said first well, the method may further include: removing said high pressure riser; removing said seal adapter; rotating said seal adapter 180 degrees; reinstalling said seal adapter in said conductor housing; connecting a first casing hanger through said second bore to the conductor housing; and connecting said high pressure riser to said conductor housing, said high pressure riser having a lower surface that extends into said first circular bore and contacts said flange, and at least one seal extending around an outside perimeter of said riser, said at least one seal contacting said side wall to facilitate well drilling operations through said high pressure riser and said first bore for a second well. When said well drilling operations are completed for said second well, the method may further include: removing said high pressure riser; connecting a second casing hanger through said first bore to the conductor housing; installing first and second casings in said first and second well, respectively; attaching a first wellhead to said conductor housing above said first well; and attaching a second wellhead to said conductor housing above said second well.

In alternate embodiments, the seal adapter may further include an upper and lower planar surface; and said step of installing said seal adapter may further include seating said lower planar surface on a flange of said conductor housing such that said upper planar surface is substantially co-planar with an upper surface of said conductor housing. The high pressure drilling and extraction operations may be conducted at well pressures up to 34.5 Mega Pascals.

BRIEF DESCRIPTION OF THE DRAWINGS

Embodiments of the invention will be better understood and readily apparent to one of ordinary skill in the art from the following written description, by way of example only, and in conjunction with the drawings, in which.

DETAILED DESCRIPTION OF THE PREFERRED EMBODIMENTS

Embodiments of the present invention provide a separate seal adapter that may be installed in a modified conductor housing. The seal adapter and modified conductor housing facilitate the drilling of well bores using standard sized drill bits, and allow for high pressure operation of the resulting wells. The example embodiment of the present invention will be discussed in an application using a standard 36 inch (0.9144 meter) conductor having two bore holes. However, it is understood that appropriately configured embodiments of the present invention may be used with conductors of any size and having two or more bore holes.

Figure 1:
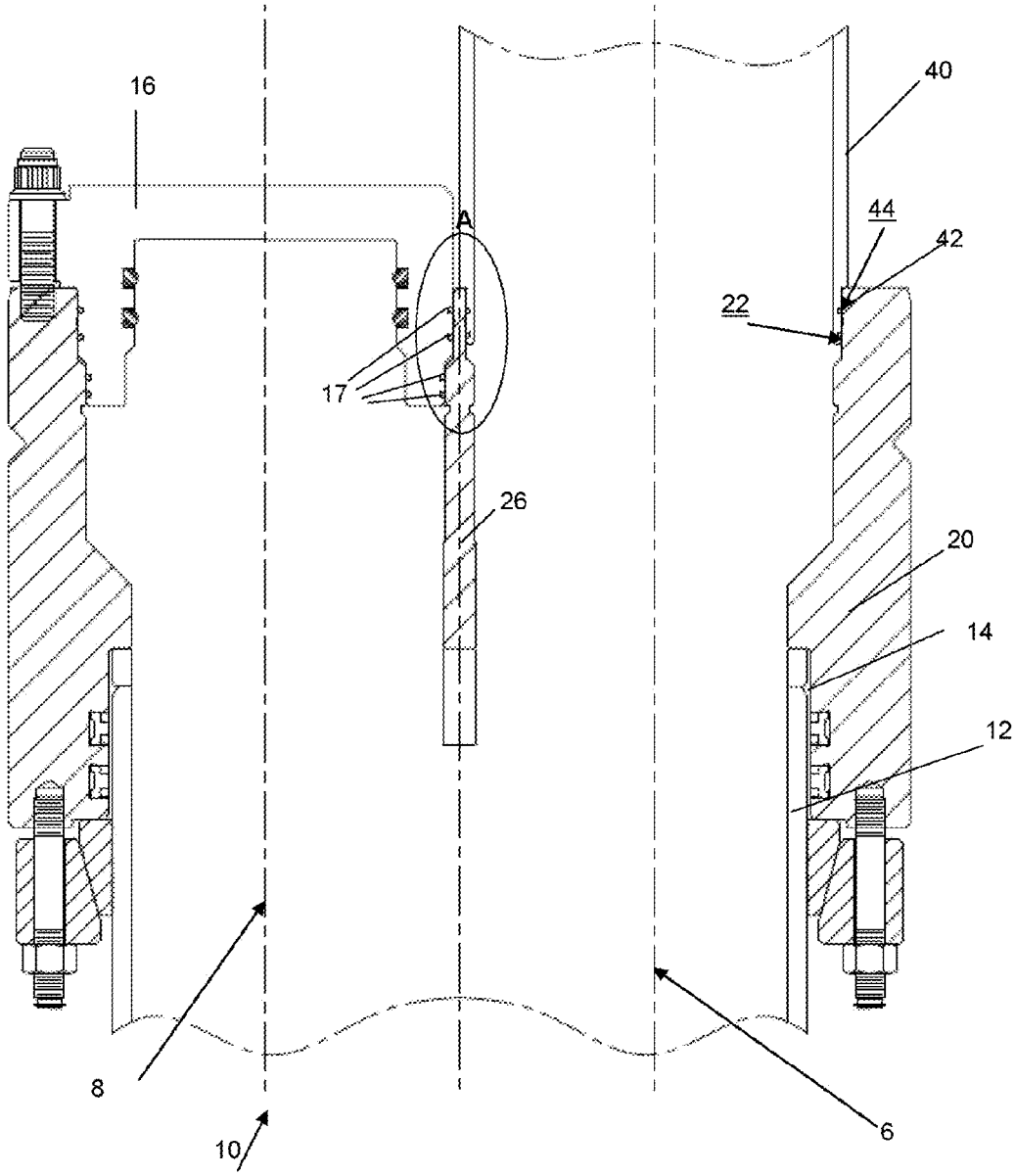
Figure 1 (PRIOR ART)
FIG. 1 illustrates a cross-sectional view of one example of a prior art conductor pipe assembly.
Figure 1A:
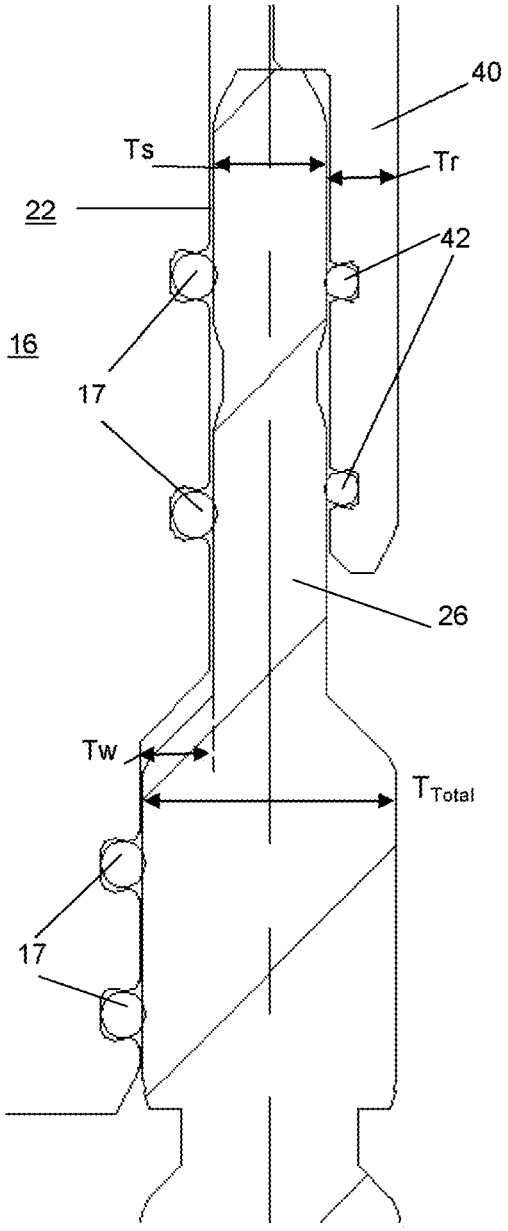
Figure 1A (PRIOR ART)
FIG. 1A illustrates a close-up cross-sectional view of the circled portion "A" of FIG. 1.
Figure 2:
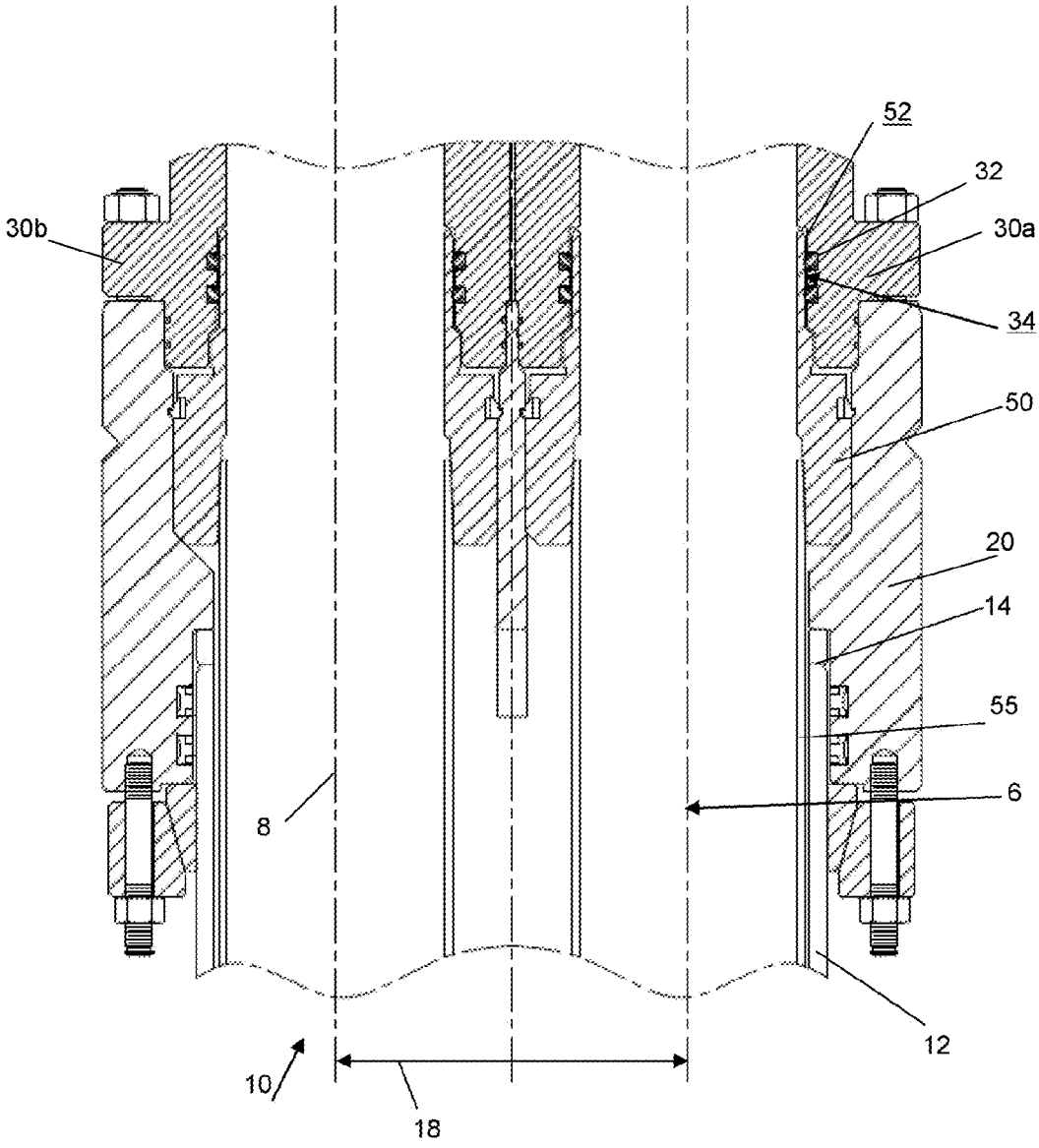
Figure 2 (PRIOR ART)
FIG. 2 illustrates a cross-sectional view of the assembly of FIG. 1 with two wellheads attached.
Figure 3:
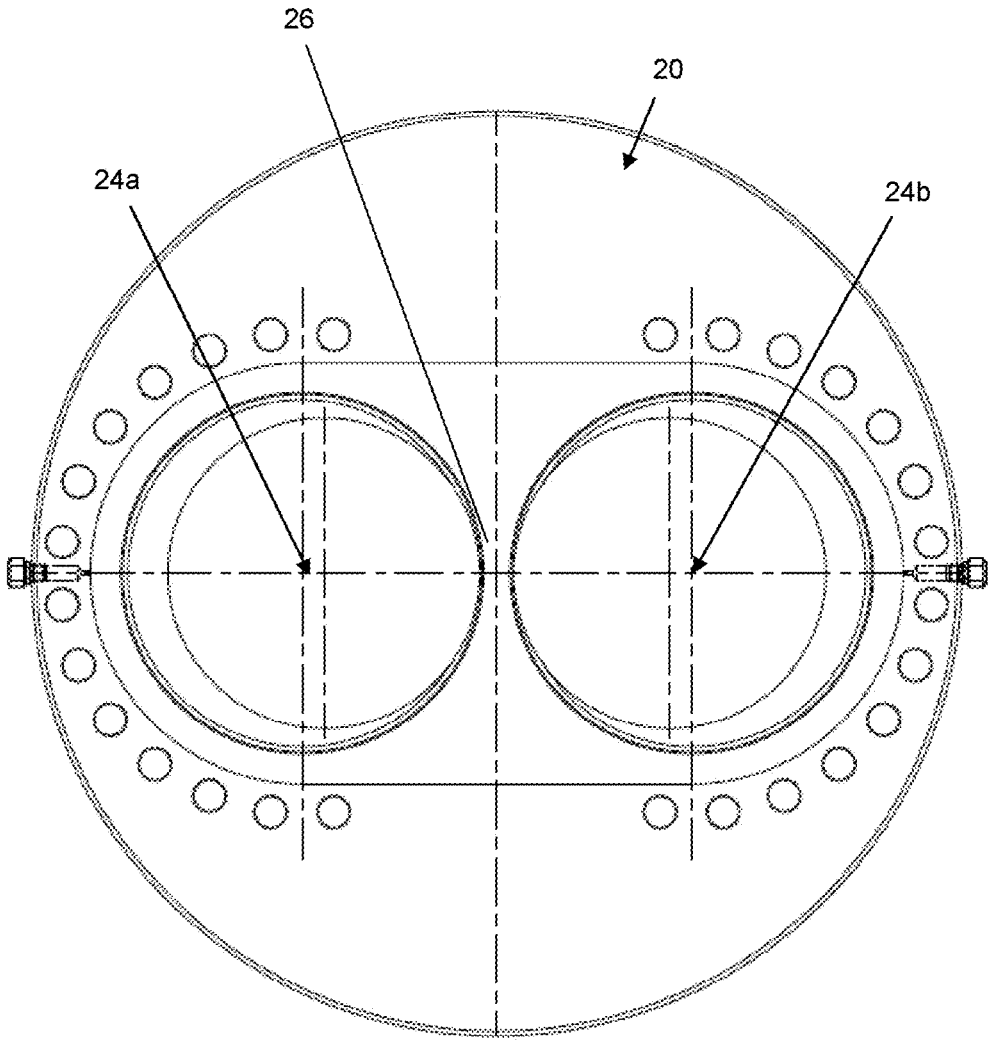
Figure 3 (PRIOR ART)
FIG. 3 illustrates a top perspective view of the conductor housing of the assembly of FIGS. 1 and 2.
Figure 4:
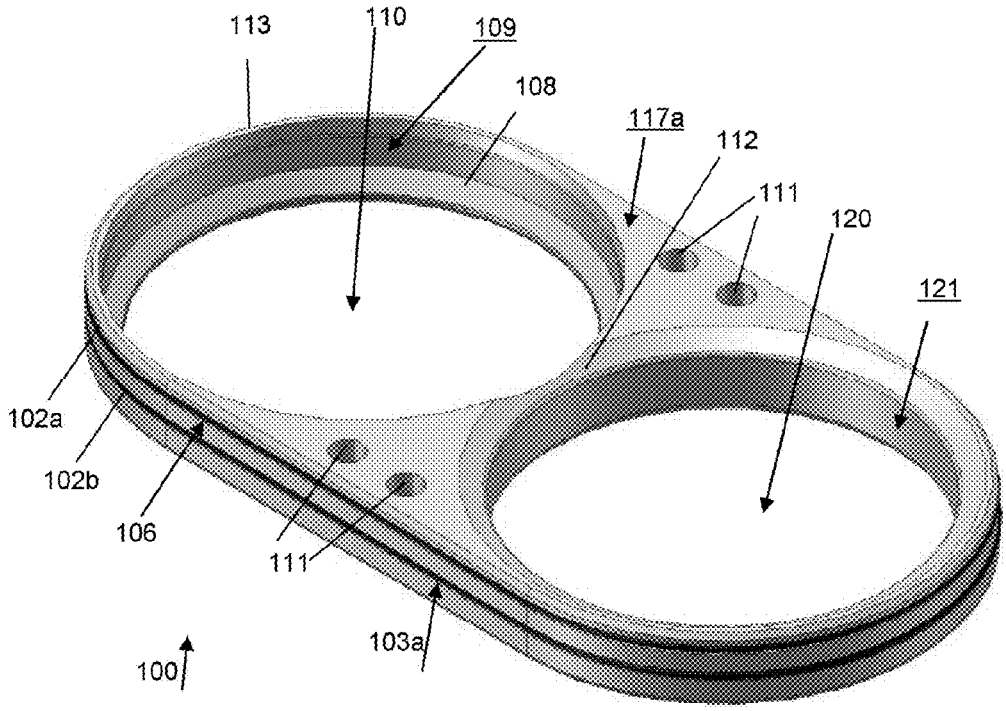
FIG. 4 illustrates a perspective view of one embodiment of a high pressure seal adapter according to the present invention.
Figure 5:
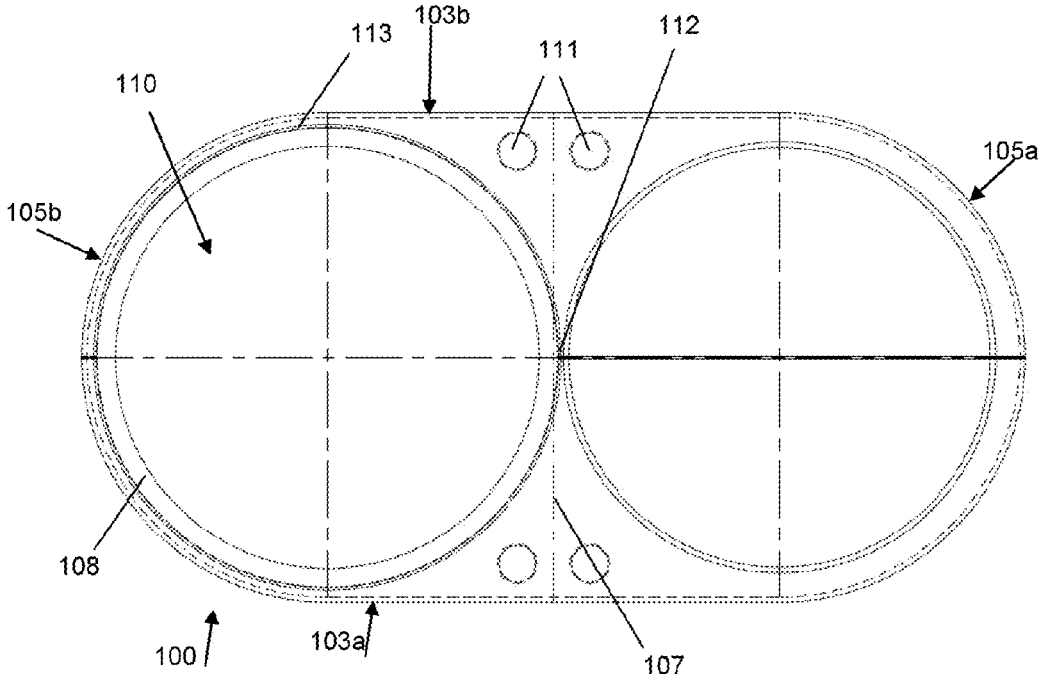
FIG. 5 illustrates a top view of the high pressure seal adapter of FIG. 4.
Figure 6:
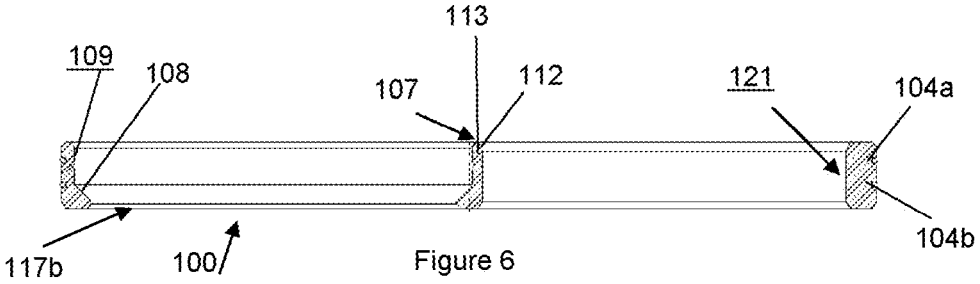
FIG. 6 illustrates a cross-sectional side view of the high pressure seal adapter of FIGS. 4 and 5.

FIG. 4 illustrates a perspective view of one embodiment of a high pressure seal adapter 100 according to the present invention. FIG. 5 illustrates a top view of the high pressure seal adapter 100 of FIG. 4. FIG. 6 illustrates a side view of the high pressure seal adapter 100 of FIGS. 4 and 5.

The seal adapter 100 includes a first bore 110 and a second bore 120 that allow equipment access through the seal adapter 100 and conductor housing 150 (FIG. 7) to the underlying conductor 12. The first bore 110 and second bore 120 are separated by a central section 112. As best shown in FIG. 5, a circular perimeter 113 of the first bore 110 extends slightly beyond a centerline 107 of the seal adapter 100. The seal adapter 100 may include one or more seals 102*a*, 102*b* located in corresponding grooves 104*a*, 104*b* respectively around an outside perimeter 106 of the seal adapter 100. In the embodiment illustrated in FIGS. 4-6, the first bore 110 may include a circular flange 108 extending partially into the bore 110 around an inside surface 109. The flange 108 may have a downward taper that helps to prevent the accumulation of debris which may occur with a flat shoulder, and which also assists in guiding tools going into the bore 110 before the riser is installed. The bore 120 includes a substantially vertical inside surface 121. This will be discussed in more detail below. The seal adapter 100 may have a planar upper surface 117*a*, and a planar lower surface 117*b*.

In this embodiment, the seal adapter 100 has a flattened oval "racetrack" profile as seen from the top (FIG. 5) with substantially straight long edges 103*a*, 103*b* and substantially circular end portions 105*a* 105*b*. However, it is understood that other profiles may also be used without departing from the scope of the appended claims. For example, in some embodiments, a triangular shaped seal adapter 100 may be used in drilling operations that provide for three well bores in a single conductor. The seal adapter 100 may also include a plurality of mounting holes 111 drilled adjacent the long edges 103*a*, 103*b* that facilitate the connection of the seal adapter 100 to the risers 40*a*, 40*b* and/or the wellheads 30*a*, 30*b*. Alternately, the mounting holes 111 may facilitate the connection of the seal adapter 100 to the underlying conductor housing 150. This will be discussed in more detail below.

Figure 7:
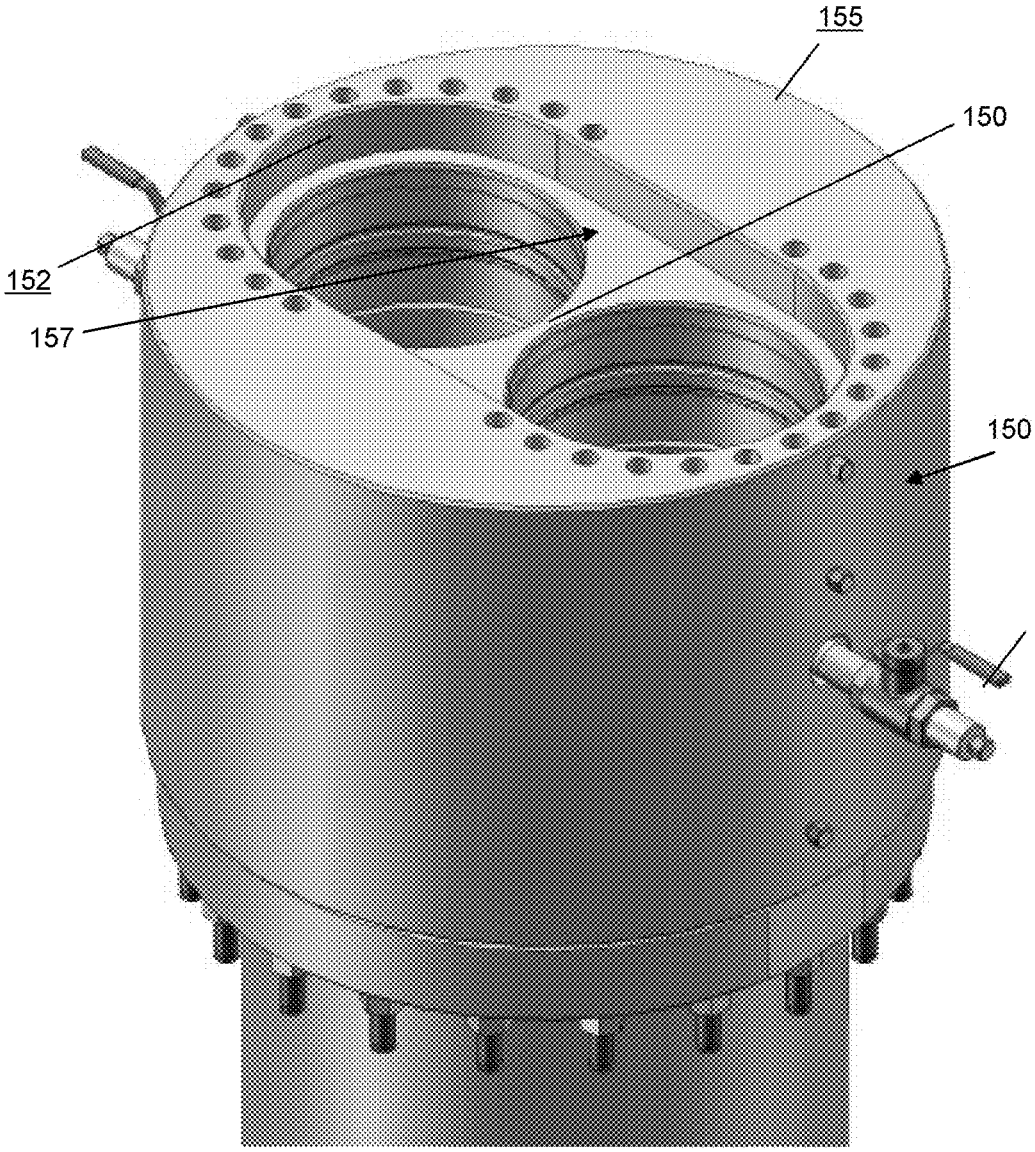
FIG. 7 illustrates a perspective view of one embodiment of a modified conductor housing that may be used with the seal adapter of FIGS. 4-6.
Figure 7A:
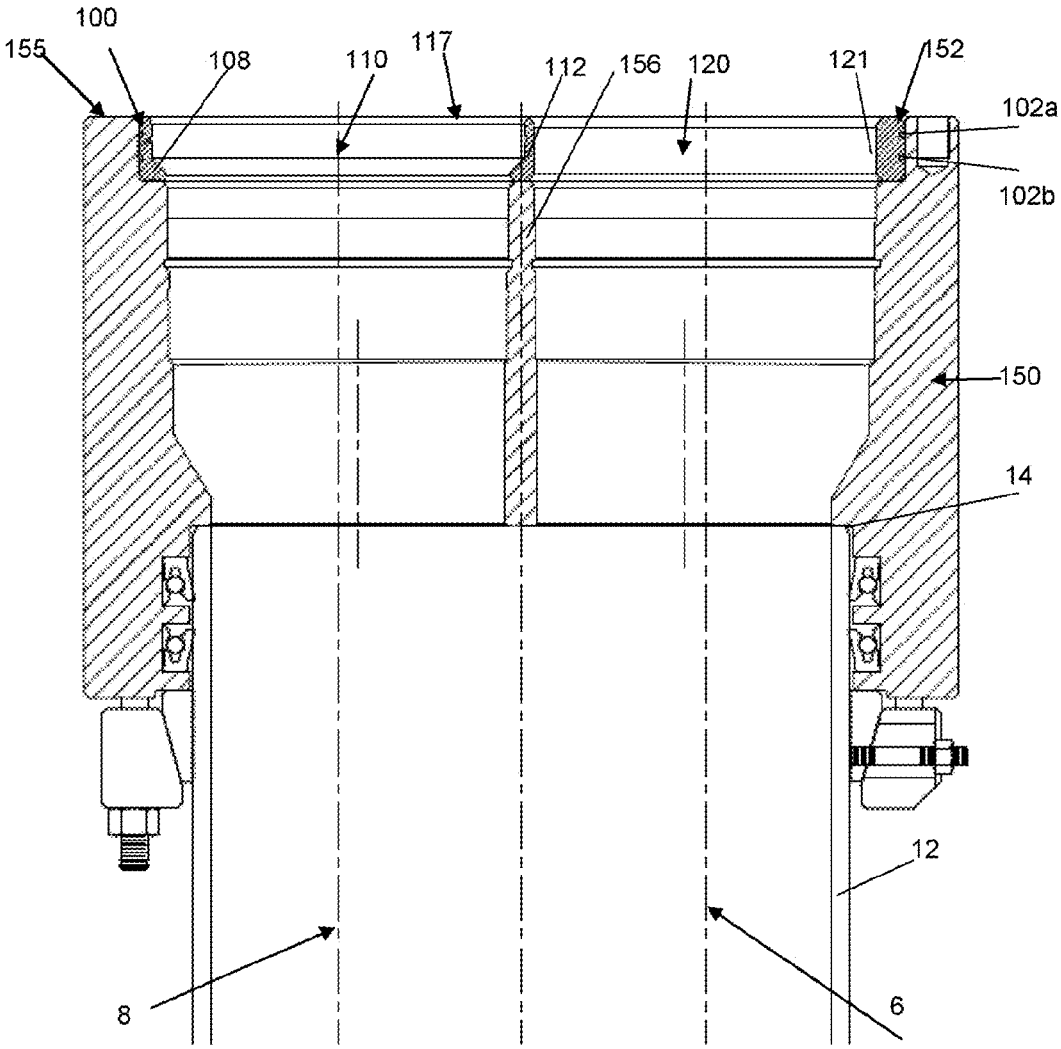
FIG. 7A illustrates a cross-sectional side view of the high pressure seal adapter of FIGS. 4-6 installed in the modified conductor housing of FIG. 7.
Figure 8:
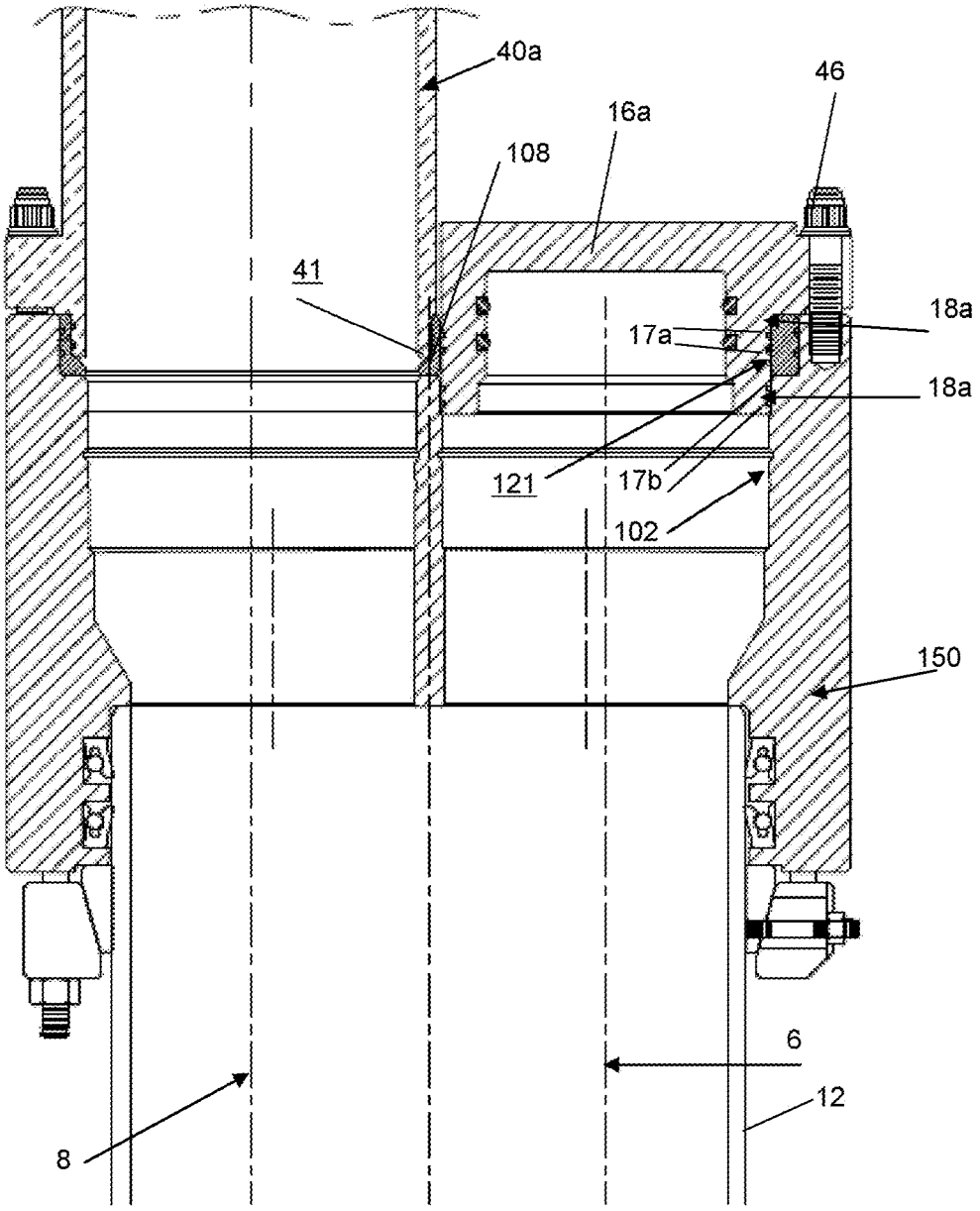
FIG. 8 illustrates a cross-sectional side view of a riser installed on the high pressure seal adapter of FIG. 7.
Figure 9:
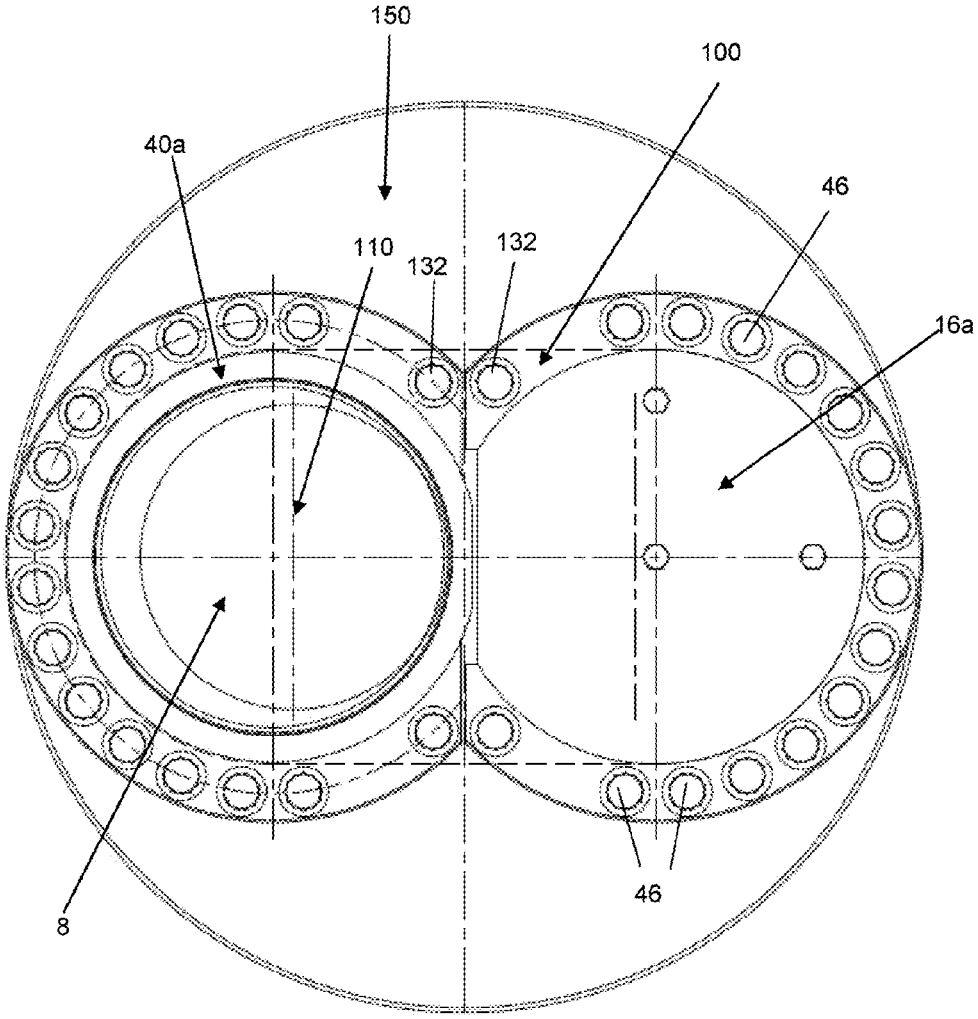
FIG. 9 is a top perspective view of the riser and seal adapter of FIG. 8.
Figure 10:
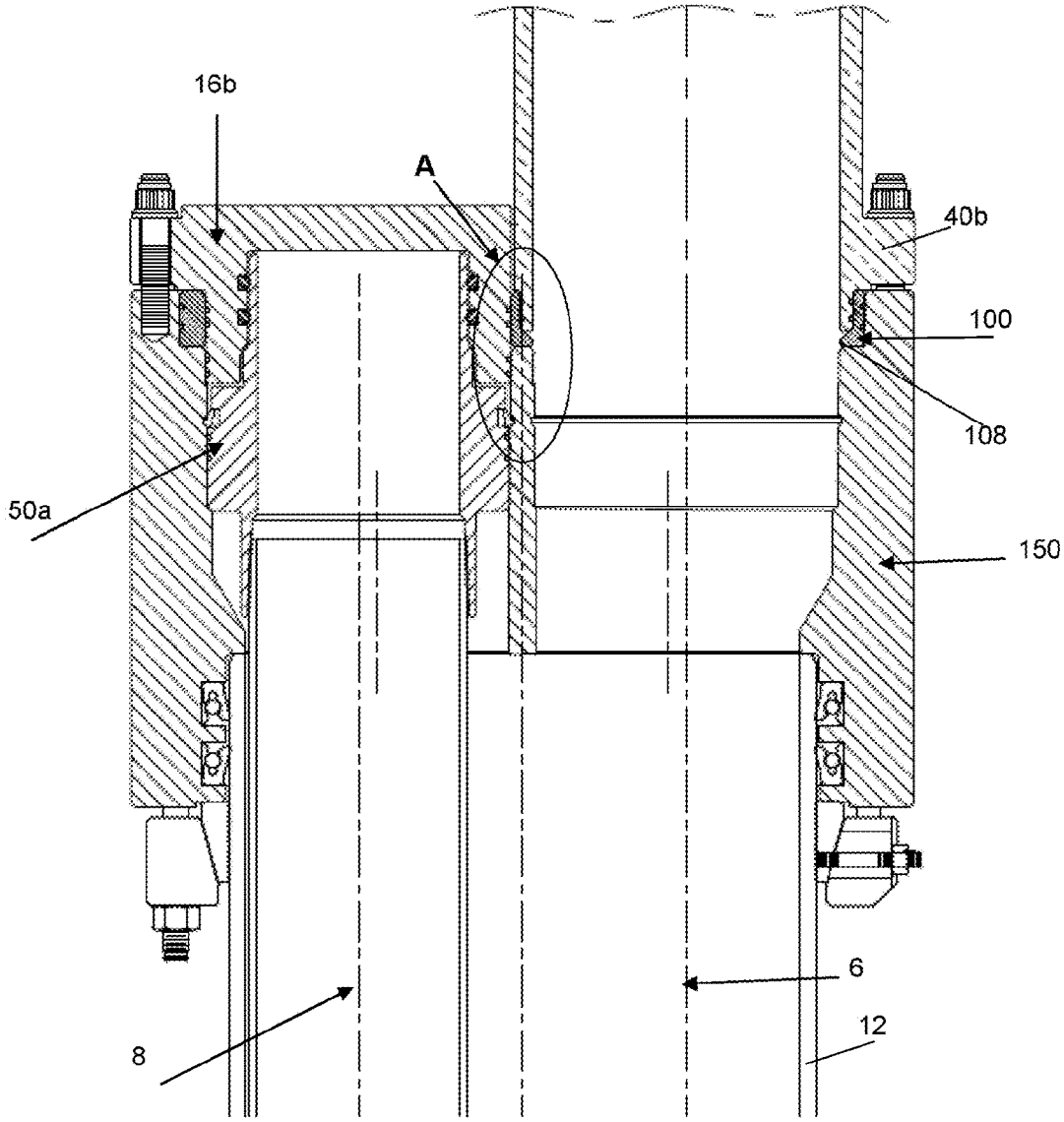
FIG. 10 illustrates a cross-sectional side view of a riser installed on the high pressure seal adapter of FIG. 7, which has been installed on the conductor housing in a reversed position.
Figure 10A:
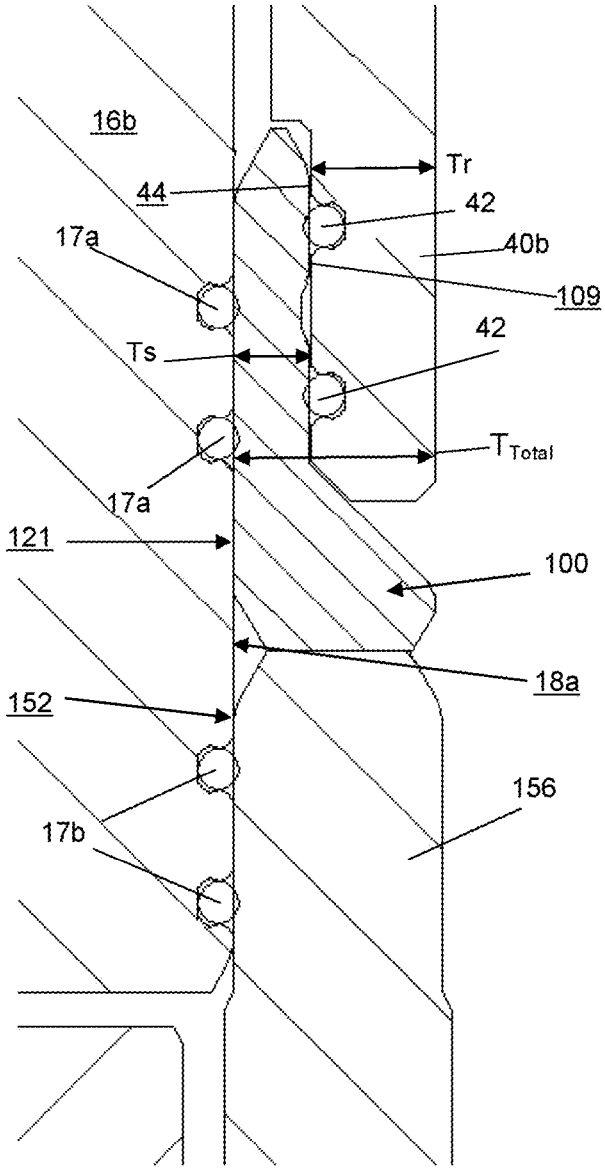
FIG. 10A illustrates a close-up cross-sectional view of the circled portion "A" of FIG. 10.

FIG. 7 illustrates a perspective view of one embodiment of a modified conductor housing 150 that may be used with the seal adapter 100 of FIGS. 4-6. FIG. 7*a* illustrates a cross-sectional side view of the high pressure seal adapter 100 of FIGS. 4-6 installed in the modified conductor housing 150 of FIG. 7. FIG. 8 illustrates a cross-sectional side view of the riser 40*a* installed on the high pressure seal adapter 100 as mounted on the conductor housing 150, as shown in FIG. 7*a*. FIG. 9 is a top perspective view of the riser 40*a* and seal adapter 100 of FIG. 8. FIG. 10 illustrates a cross-sectional side view of the seal adapter 100 in a reversed position on the conductor housing 150. This facilitates the installation of another riser 40*b* that may be used to facilitate well completion for the well bore 6. It is understood that riser 40*a* may also be repositioned above well bore 6 for this purpose. FIG. 10A illustrates a close-up cross-sectional view of the circled portion "A" of FIG. 10.

The installation and operation of the seal adapter 100 will now be described with reference to FIGS. 7-10. As discussed above, once the conductor 12 has been driven into the ground at the desired drilling location, the conductor housing 150 is installed onto the top 14 of the conductor 12. This process is known to those of skill in the art, and will not be described in detail here. It is understood that the conductor 12 may also be used in subsea operations. Embodiments of the present invention are thus not limited to surface wells, but may be used in any well drilling operation in which a conductor housing 150 is installed onto a conductor 12.

With reference to FIG. 7, once the conductor housing 150 has been installed onto the top 14 of the conductor 12, the seal adapter 100 may be installed into the top of the conductor housing 150. In this embodiment, a portion of central section 156 of the conductor housing 150 has been removed to provide a flange 157 to facilitate the connection between the seal adapter 100 and the conductor housing 150. In this illustration, bore 110 of the seal adapter 100 is positioned above well bore 8 to facilitate well drilling operations (FIG. 7*a*).

When installed in the conductor housing 150, a portion of the lower surface 117*b* of the seal adapter 100 rests on the corresponding flange 157 in the conductor housing 150, while the upper surface 117*a* of the seal adapter 100 is substantially flush with a top surface 155 of the conductor housing 150. The seals 102*a*, 102*b* provide a pressure tight seal between the seal adapter 100 and an inside surface 152 of the conductor housing 150. A bolt 132 may extend through corresponding holes in the risers 40*a*, 40*b* or wellheads 30*a*, 30*b* into each of the drill holes 111 of the seal adapter 100. In alternate embodiments, the bolts 132 may extend through each of the drill holes 111 into corresponding holes in the conductor housing 150 to secure the seal adapter 100 to the conductor housing 150.

As shown in FIGS. 8 and 9, the riser 40*a* may then be installed in bore 110 of the seal adapter 100 above wellbore 8. As is known in the art, the riser 40*a* may be thinner on one side to allow dismantling of the trash cap 16*a* (FIG. 8) while the riser 40*a* is in place. A lower surface 41 of the riser 40*a* may contact the flange 108 in the bore 110 of the seal adapter 100. The riser 40*a* may then be attached to the conductor housing 150 using a plurality of bolts 46 (FIG. 9). A trash cap 16*a* may also be installed into bore 120 of the seal adapter 100. The trash cap 16*a* may include one or more seals 17*a*, 17*b* between the inside surface 121 of the bore 120 and an outside surface 18*a* of the trash cap 16*a*. The trash cap 16*a* may also include one or more seals 17*b*, 17*b* between the inside surface 152 of the conductor housing 150 and the outside surface 18*a* of the trash cap 16*a*.

After the riser 40*a* is installed, various tools are run inside the riser 40*a* to test the connection, drill for the next casing depth, wash the bore and to perform other well operations. Once drilling operations are completed, the riser 40*a* and trash cap 16*a* are removed from the conductor housing 150.

With reference to FIG. 10, the seal adapter 100 may then be removed, rotated 180 degrees such that the bore 110 is positioned above well bore 6, and reinstalled into the conductor housing 150 as previously described. A casing hanger 50*a* may then be installed through bore 120 of seal adapter 100, and connected to the conductor housing 150. A trash cap 16*b* may then be installed in the bore 120 of the seal adapter 100, and onto the casing hanger 16*b* to protect the casing hanger 16*b* from debris. The riser 40*b* may then be installed in bore 110 of the seal adapter 100 above wellbore 6. Drilling and other well operations are then commenced as previously described.

FIG. 10*a* illustrates a close-up cross-sectional view of the circled portion "A" of FIG. 10. As best shown in FIG. 10*a*, one or more seals 42 are located at the bottom of the riser 40*a* between an outside surface 44 of the riser 40*b* and the inside surface 109 of the seal adapter 100. Similarly, the trash cap 16*b* may also include one or more seals 17*a* between the inside surface 121 of the bore 120 and the outside surface 18*b* of the trash cap 16*b*, as well as one or more seals 17*b* between the inside surface 152 of the conductor housing 150 and the outside surface 18*b* of the trash cap 16*b*.

By employing the seal adapter 100 in the modified conductor housing 150, the thickness $T_r$ of the riser 40*b* can be increased, while the total available thickness $T_{total}$ is approximately the same. This allows for increased pressures in the riser 40*b* using the same conductors of the prior art.

Figure 11:
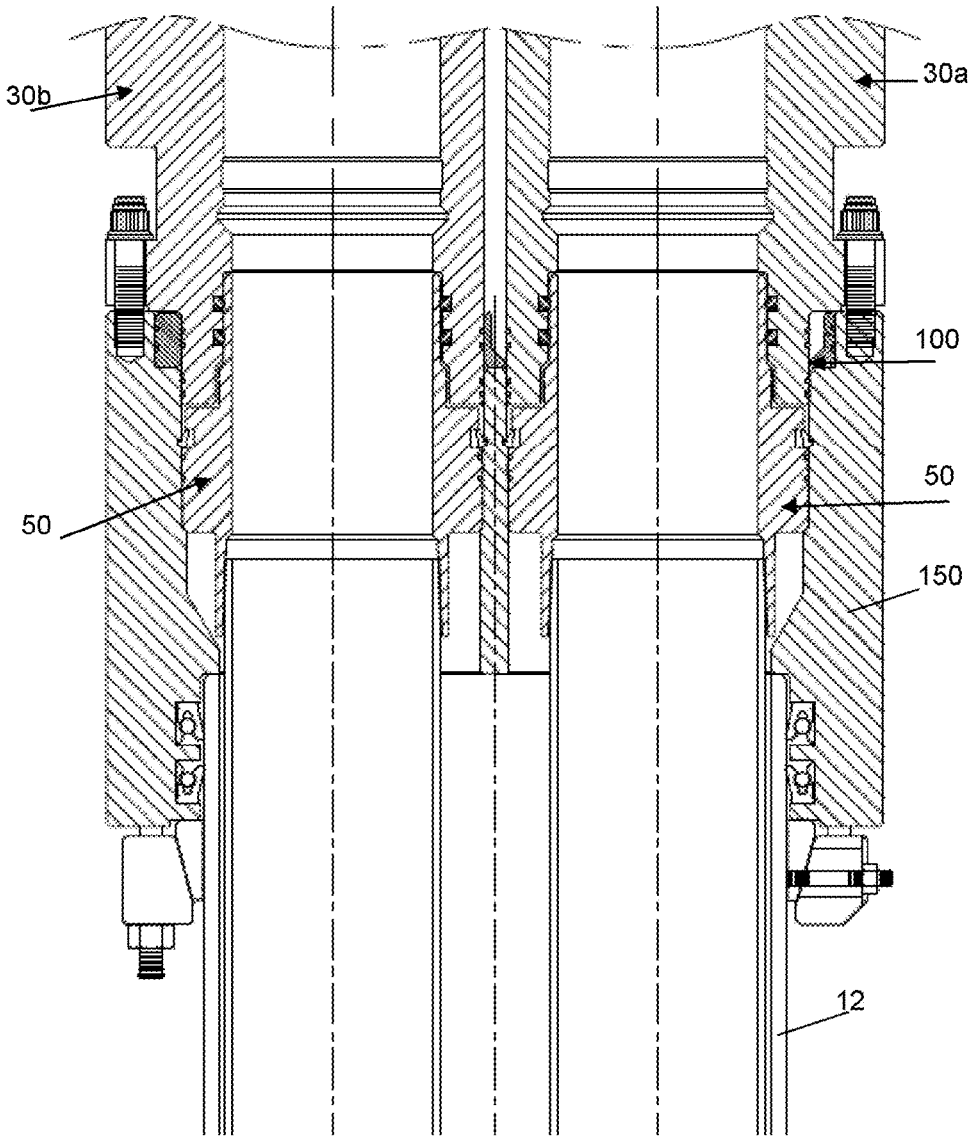
FIG. 11 illustrates a cross-sectional side view of two completed wellheads installed on the high pressure seal adapter of FIG. 7.

FIG. 11 illustrates a cross-sectional side view of two wellheads 30*a*, 30*b* installed on the conductor housing 150 containing the high pressure seal adapter 100 of FIG. 7. In this completed well, both of the casing hangers 50 and wellheads 30*a*, 30*b* have been installed onto the conductor housing 150. The seal adapter 100 is left in the conductor housing 150. As shown in the illustration, the seal adapter 100 does not interfere with the installation of the wellhead(s) 30*a*, 30*b*. The final position and orientation of the seal adapter 100 does not affect well operations. Subsequent operations from the installation of the wellhead 30*a*, 30*b* onwards are per normal well drilling and installation procedures, as know to those of skill in the art.

As best shown in FIGS. 8, 10 and 10*a*, the seal adapter 100 addresses the problems discussed above by shifting the seal position of the risers 40*a*, 40*b* from the conductor housing 20 of the prior art to the seal adapter 100. Since the first bore 110 of the seal adapter 100 is slightly larger than what was available in the prior art, a riser 40*a* having thicker walls may be used without reducing the size of the drill bit, or increasing the size of the conductor. The seal adapter 100 can be removed from the conductor housing 150, rotated 180 degrees, and reinstalled in the conductor housing to facilitate riser installation through bore 110 of the seal adapter 100 to either of the 2 well bores 6, 8. This allows the risers 40*a*, 40*b* to be thicker than the conventional design, and still maintain the same inner diameter for equipment to pass through it. The thicker riser design allows for a higher overall pressure rating for each of the wells. By way of example and not limitation, a well that has been prepared as described above, and configured as shown in FIGS. 7-11, may safely operate at pressures of up to 5000 psi (34.5 MPa). It is understood that even higher pressures may be obtained by using non-standard materials for the seal adapter.

It will be appreciated by a person skilled in the art that numerous variations and/or modifications may be made to the present invention as shown in the specific embodiments without departing from the spirit or scope of the invention as broadly described. The present embodiments are, therefore, to be considered in all respects to be illustrative and not restrictive.

What is claimed is:

1. A high pressure seal adapter for a conductor housing of a wellhead, the high pressure seal adapter having a unitary body comprising:

a first circular bore extending through said unitary body, the first circular bore having a circular perimeter extending beyond a centerline of said unitary body; and a second circular bore adjacent the first circular bore and extending through said unitary body; wherein the centerline of said unitary body defines the first circular bore and the second circular bore by positioning the centerline between the first circular bore and the second circular bore; and where in said seal adapter is configured to be installed in said conductor housing of said wellhead.

2. The high pressure seal adapter of claim 1, further comprising at least one seal extending around a perimeter of said unitary body, said at least one seal is configured to contact said conductor housing.

3. The high pressure seal adapter of claim 1, further comprising an upper and lower planar surface, wherein said lower planar surface is configured to rest on a flange of said conductor housing, such that said upper planar surface is substantially co-planar with an upper surface of said conductor housing.

4. The high pressure seal adapter of claim 1, wherein said seal adapter is configured to be rotated 180 degrees and installed in said conductor housing to facilitate well drilling operations for a second well.

5. The high pressure seal adapter of claim 1, wherein said seal adapter is configured to operate at well pressures up to 34.5 Mega Pascals.

6. The high pressure seal adapter of claim 1, wherein the first circular bore comprises a flange extending partially into the first circular bore around an inside surface of the first circular bore.

7. The high pressure seal adapter of claim 6, wherein the first circular bore is configured to receive a high pressure riser, said high pressure riser having a lower surface that contacts said flange and at least one seal extending around an outside perimeter of said riser, to facilitate well drilling operations through said high pressure riser and said first circular bore for a first well.

8. The high pressure seal adapter of claim 7, wherein the flange comprises a downward taper.

9. A method of completing a well, the well comprising a wellhead with a conductor having a conductor housing attached thereto, the method comprising the steps of:

providing a high pressure seal adapter having a unitary body comprising:

a first circular bore extending through said unitary body, the first circular bore defining a circular perimeter extending beyond a centerline of said unitary body: and a second circular bore adjacent said first circular bore and extending through said unitary body; wherein the centerline of said unitary body defines the first circular bore and the second circular bore by positioning the centerline between the first circular bore and the second circular bore; and where in installing said seal adapter in said conductor housing of said wellhead.

10. The method of claim 9, further comprising:

connecting a high pressure riser to said conductor housing, said high pressure riser having a lower surface that extends into said first circular bore and contacts a flange in said first circular bore, and at least one seal extending around an outside perimeter of said high pressure riser, to facilitate well drilling operations through said high pressure riser and said first circular bore for a first well.

11. The method of claim 10, further comprising the steps of:

removing said high pressure riser;

removing said seal adapter;

rotating said seal adapter 180 degrees;

reinstalling said seal adapter in said conductor housing;

connecting a first casing hanger through said second circular bore to the conductor housing; and connecting said high pressure riser to said conductor housing, said high pressure riser having a lower surface that extends into said first circular bore and contacts said flange, and at least one seal extending around an outside perimeter of said riser, said at least one seal contacting said side wall to facilitate well drilling operations through said high pressure riser and said first circular bore for a second well.

12. The method of claim 11, further comprising the steps of:

removing said high pressure riser;

connecting a second casing hanger through said first circular bore to the conductor housing;

installing first and second casings in said first and second wells, respectively;

attaching a first wellhead to said conductor housing above said first well; and attaching a second wellhead to said conductor housing above said second well.

13. The method of claim 11, wherein said high pressure drilling and extraction operations are conducted at well pressures up to 34.5 Mega Pascals.

14. The method of claim 10, wherein said high pressure drilling and extraction operations are conducted at well pressures up to 34.5 Mega Pascals.

15. The method of claim 9, wherein;

said seal adapter further comprises an upper and lower planar surface; and said step of installing said seal adapter further comprises seating said lower planar surface on a flange of said conductor housing such that said upper planar surface is substantially co-planar with an upper surface of said conductor housing.

* * * * *